US007500329B2

(12) United States Patent
Downey

(10) Patent No.: US 7,500,329 B2
(45) Date of Patent: Mar. 10, 2009

(54) OPERATING SYSTEM FOR A SHUTTER TYPE COVERING FOR ARCHITECTURAL OPENINGS

(75) Inventor: Joseph M. Downey, Gilbert, AZ (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 504 days.

(21) Appl. No.: 11/218,131

(22) Filed: Sep. 1, 2005

(65) Prior Publication Data

US 2006/0042164 A1 Mar. 2, 2006

Related U.S. Application Data

(60) Provisional application No. 60/607,038, filed on Sep. 2, 2004.

(51) Int. Cl.
*E06B 7/086* (2006.01)

(52) U.S. Cl. ..... 49/87.1; 49/74.1

(58) Field of Classification Search ..... 49/74.1, 49/87.1, 90.1, 92.1, 403
See application file for complete search history.

(56) References Cited

U.S. PATENT DOCUMENTS

| | | | | | |
|---|---|---|---|---|---|
| 22,172 | A | * | 11/1858 | Fay et al. | 49/74.1 |
| 312,053 | A | * | 2/1885 | Willer | 49/74.1 |
| 1,722,059 | A | * | 7/1929 | Riker | 454/319 |
| 2,060,615 | A | * | 11/1936 | Ernst | 454/134 |
| 2,152,705 | A | * | 4/1939 | Mortimer | 160/188 |
| 2,164,814 | A | * | 7/1939 | Griffith | 49/87.1 |
| 2,220,405 | A | * | 11/1940 | Jones | 49/86.1 |
| 2,225,332 | A | * | 12/1940 | Collins | 49/82.1 |
| 2,314,492 | A | * | 3/1943 | Guettler | 49/77.1 |
| 2,324,454 | A | * | 7/1943 | Huff | 49/403 |
| 2,509,774 | A | * | 5/1950 | Leigh | 49/87.1 |
| 2,631,341 | A | * | 3/1953 | Pettigrew et al. | 49/74.1 |
| 2,635,306 | A | * | 4/1953 | Zankl | 49/87.1 |
| 2,649,629 | A | * | 8/1953 | Baxter et al. | 49/390 |
| 2,697,858 | A | * | 12/1954 | Brenner | 49/403 |
| 2,716,786 | A | * | 9/1955 | Moore | 49/403 |
| 2,737,694 | A | * | 3/1956 | Silvers | 49/403 |
| 2,748,432 | A | * | 6/1956 | Eaddy, Sr. | 49/403 |
| 2,798,264 | A | * | 7/1957 | Collar | 49/91.1 |
| 2,807,840 | A | * | 10/1957 | Wurzel | 49/403 |
| 2,845,153 | A | * | 7/1958 | West | 49/371 |
| 2,902,731 | A | * | 9/1959 | Sconzo | 49/403 |
| 2,930,251 | A | * | 3/1960 | Cline | 74/491 |
| 3,060,529 | A | * | 10/1962 | Clay | 49/58 |
| 3,110,936 | A | * | 11/1963 | Berard | 49/91.1 |
| 3,123,189 | A | * | 3/1964 | Wiley | 49/77.1 |
| 3,130,458 | A | * | 4/1964 | Zacharias | 49/403 |
| 3,183,561 | A | * | 5/1965 | Spicer | 49/403 |
| 3,196,498 | A | * | 7/1965 | Hochuli, Jr. et al. | 49/403 |

(Continued)

*Primary Examiner*—Katherine W Mitchell
*Assistant Examiner*—Catherine A Kelly
(74) *Attorney, Agent, or Firm*—Dorsey & Whitney LLP

(57) ABSTRACT

A shutter includes top and bottom frames as well as interconnecting perpendicular styles between which a plurality of louvers are pivotally mounted. Each louver has a first tap in its opposite ends for receipt of a pivot pin and a second tap in at least one end for receipt of a tilt pin for pivotal interconnection with a tilt bar. The tilt pins are positioned adjacent to one longitudinal edge of a louver whereby the tilt bar can be easily fastened thereto and positioned adjacent a longitudinal end of the louvers.

6 Claims, 11 Drawing Sheets

U.S. PATENT DOCUMENTS

| | | | | | |
|---|---|---|---|---|---|
| 3,254,451 | A * | 6/1966 | Wills et al. | 49/74.1 |
| 3,327,426 | A * | 6/1967 | Spicer | 49/74.1 |
| 3,741,102 | A * | 6/1973 | Kaiser | 454/319 |
| 4,114,646 | A * | 9/1978 | McCabe | 137/601.09 |
| 4,268,995 | A * | 5/1981 | Villa | 49/87.1 |
| 4,481,734 | A * | 11/1984 | Vaida | 49/91.1 |
| 5,267,414 | A * | 12/1993 | Vaida | 49/74.1 |
| 5,338,252 | A * | 8/1994 | Bowler et al. | 454/155 |
| 6,041,547 | A * | 3/2000 | Marocco | 49/87.1 |
| 6,401,391 | B2 * | 6/2002 | Gabriele | 49/87.1 |
| 6,928,778 | B2 | 8/2005 | Schmid | |
| 7,082,719 | B2 * | 8/2006 | Regnery | 49/74.1 |
| 7,124,537 | B2 * | 10/2006 | Young | 49/74.1 |
| 2001/0037604 | A1 * | 11/2001 | Gabriele | 49/74.1 |
| 2002/0026749 | A1 * | 3/2002 | Lee | 49/74.1 |
| 2002/0056230 | A1 * | 5/2002 | Horn et al. | 49/74.1 |
| 2003/0101653 | A1 * | 6/2003 | Biro | 49/74.1 |
| 2004/0025438 | A1 * | 2/2004 | Marocco | 49/87.1 |
| 2004/0226221 | A1 * | 11/2004 | Regnery | 49/74.1 |
| 2006/0248801 | A1 * | 11/2006 | Marocco | 49/74.1 |

* cited by examiner

OPERATING SYSTEM FOR A SHUTTER TYPE COVERING FOR ARCHITECTURAL OPENINGS

CROSS-REFERENCE TO RELATED APPLICATION

This application claims the benefit of U.S. provisional application Ser. No. 60/607,038 filed Sep. 2, 2004, which application is hereby incorporated by reference as if fully disclosed herein.

FIELD OF THE INVENTION

The present invention relates generally to a tilt bar for controlling the louvers of a shutter for coverings for architectural openings and more particularly to a tilt pin for attachment of the tilt bar to the louvers.

DESCRIPTION OF THE RELEVANT ART

Generally, a tilt bar is used to control louvers in a shutter for a covering in an architectural opening. The tilt bar may be connected to the louvers in such a manner as to enable the louvers to be opened or closed simultaneously thereby maintaining an equal spacing and orientation among the louvers.

Several different means for attaching a tilt bar to the louvers in a shutter are well known. In one example, U-shaped staples are attached to the longitudinal louver edge with a complimentary U-shaped staple at the rear edge of a wooden shutter bar. These staple-like fasteners may be hammered into the louver at the center of the louver or applied from a staple gun. This type of fastening has several disadvantages. One being that the staple-like fastener may split the wood, requiring the louver to be discarded and replaced, at a loss of both time and expense. Another disadvantage is that the connection between the staple-like fastener in the louver and tilt bar is very loose. The loose attachment is noisy and allows the tilt bar to drop against the bottom bar causing wear thereto.

Another example of attachment of a tilt bar to the louvers is fixedly fastening the tilt bar to the inside longitudinal edge of the louver. A wood screw- or nail type fastener may be used to fixedly attach the tilt bar at an opening adapted to receive the screw fastener or nail at the longitudinal edge of the louver. In this example, the screw may loosen over time from use. Consequently, the tilt bar becomes loose enough to interfere with the stile causing unnecessary wear thereto.

It is to overcome such shortcomings in prior art connection systems that the present invention was developed.

SUMMARY OF THE INVENTION

The above discussed and other problems are solved by the shutter control system of the present invention. The invention provides an improved tilt bar with longitudinally-spaced connectors that may be efficiently clipped to tilt pins on the ends of the louvers in the shutter which are adapted to receive the connectors. The tilt bar is therefore attached at a longitudinal end of the louver rather than at the center of the louver, thus improving the view through the louvers. In addition, the tilt bar of the invention may be located adjacent to a rearward edge of the louvers.

Architectural openings typically have a frame therearound and the shutter is installed to fit within the frame. Shutters comprise two vertical stiles in parallel relationship to each other, a horizontal head bar, a horizontal bottom bar, and a plurality of horizontal louvers attached in spaced, parallel relationship to the stiles. The stiles, head bar and bottom bar cooperatingly fit within the frame of the architectural opening.

The system of the present invention in one embodiment comprises a combination of the tilt bar and dual headed pins that are used to control the position of the louvers. The tilt bar is positioned at one longitudinal end of the louvers and may be attached adjacent to the rearward edge of the louvers. Each louver is prepared for installation in the stiles. Preparation is completed by pre-drilling each louver at two locations to create a first tap opening and a second tap opening at each end of the louver. The end of the louver as used herein is defined as the end of the louver that is adjacent to the stile and perpendicular to the longitudinal axis of the louver. It is to be understood that the description of positioning the first and second taps in the louver is at both ends and to the plurality of louvers equally. Thus, the description at one end is understood to mean it is to be applied to the additional end of each louver and plurality of louvers as well.

The first tap is positioned at the center of the end of the louver for receiving a longitudinally-extending pivot shaft or dowel. The pivot shaft or dowel provides for pivotable attachment of the louver to the stile and is parallel to the longitudinal axis of the louver. The second tap is positioned at a location other than at the center of the end of the louver. The second tap is adapted for receiving a dual headed tilt pin. It will be appreciated the second tap is positioned so as to provide the best leverage to rotate the louver, namely at a position maximally spaced from the first tap. The louvers are then installed into the stiles. The assembly is completed when the head bar and bottom bar are connected to the stiles. Next, dual-headed tilt pins having first and second axially spaced heads are press fitted into the second tap at one end of the louver. The second head serves as a stop to limit the distance the pin may be inserted. Moreover, each dual headed pin has a knurled portion thereon which grips the wall of the second tap to prevent the pin from being easily withdrawn. Once the pin is inserted up to the extent of the second head, a portion of the pin remains exteriorly of the louver end. Thus exposed, the spacing between the first head and second head defines a neck. The neck has a diameter adapted to receive and cooperate with a connector on the tilt bar.

The tilt bar has open-ended connectors, preferably in the form of sockets, equally spaced thereon. The open ended sockets have a plurality of arms that form an oval opening for capturing the neck of the dual-headed pin. The arms are resilient to enable them to spread open so as to releasably capture the neck. As will be appreciated, the equal vertical spacing of the louvers in parallel relationship between the stiles also place the dual heads of the tilt pins on the louvers in a vertically spaced relationship. The spaced relationship of the pins is adapted to that of the spaced relationship of the open ended sockets on the tilt bar. Thus, in this relationship, the open ended sockets of the tilt bar "clip" to the necks of the dual headed tilt pins so as to form a releasable attachment therewith. Moreover, once the tilt bar is attached to the plurality of tilt pins, translation of the tilt bar tilts the plurality of louvers or pivots the louvers about longitudinal axes.

In another embodiment of the invention, the system comprises a single headed tilt pin and a tilt bar having a closed connector in the form of a socket. The combination of the tilt bar and tilt pins cooperate to control the positions of the louvers. The preparation of the louver is as was discussed above. However, in this embodiment, the tilt bar is attached to the louver by the single-headed tilt pin. The tilt bar accepts the tilt pin through an opening in the closed socket of the tilt bar. The opening of the closed socket is of oval shape and adapted to fit the neck of the single headed tilt pin. The tilt bar captures the pin at the socket in the tilt bar so as to attach the tilt bar to the louver. A raised surface adjacent the single head is adapted to be a bearing surface for movement of the tilt bar. Knurled surfaces of the single headed tilt pin grip the inside wall of the second tap to prevent the pin from being easily withdrawn from the second tap.

DETAILED DESCRIPTION OF THE PREFERRED EMBODIMENT

Figure 1:
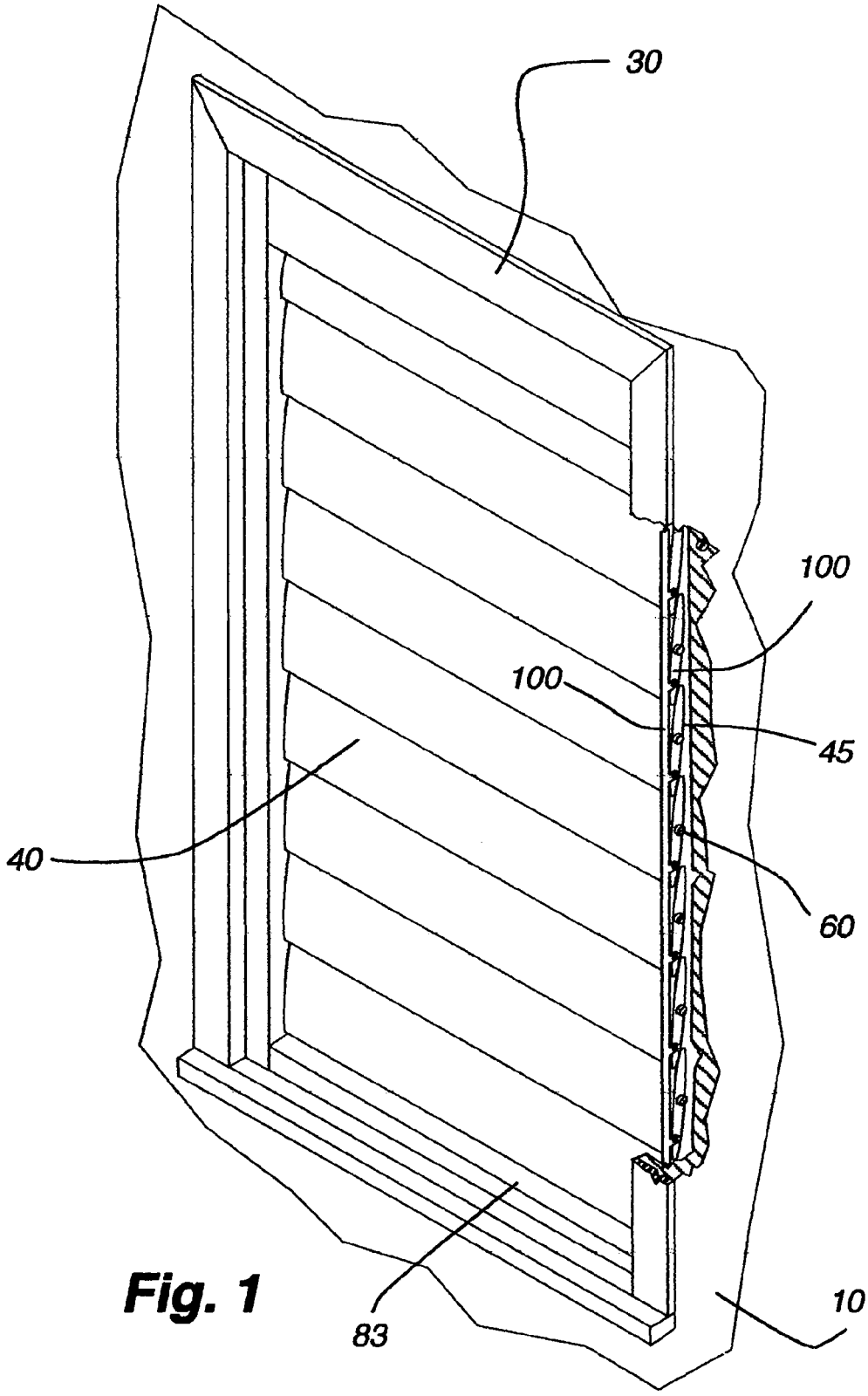
FIG. 1 is an isometric of a shutter showing a cut-away of the invention attached to the louvers.
Figure 6:
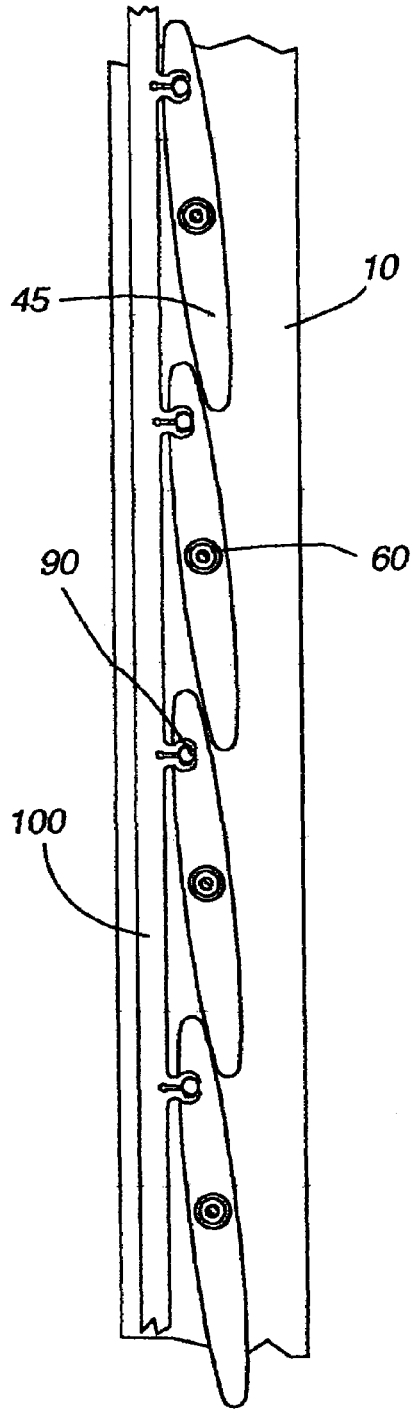
FIG. 6 is a section similar to FIG. 5 with the louvers in a different position.

FIGS. 1-6 illustrate the tilt bar of the invention in relation to a shutter. FIG. 1 shows the front of a shutter 50 for covering an architectural covering. Shutter 50 comprises stiles 10, a head bar (not seen) a bottom bar 83, a plurality of louvers 40 and a tilt bar 100. The tilt bar 100 is shown in its closed position with louvers 40 tilted in a substantially vertical or closed position. As will be appreciated from FIGS. 3-4, movement of the tilt bar in an upward direction pivots the louvers in a clockwise direction through an open position and ultimately into a closed position. As seen in FIG. 6 in the closed position, the louvers abut one another.

Figure 2:
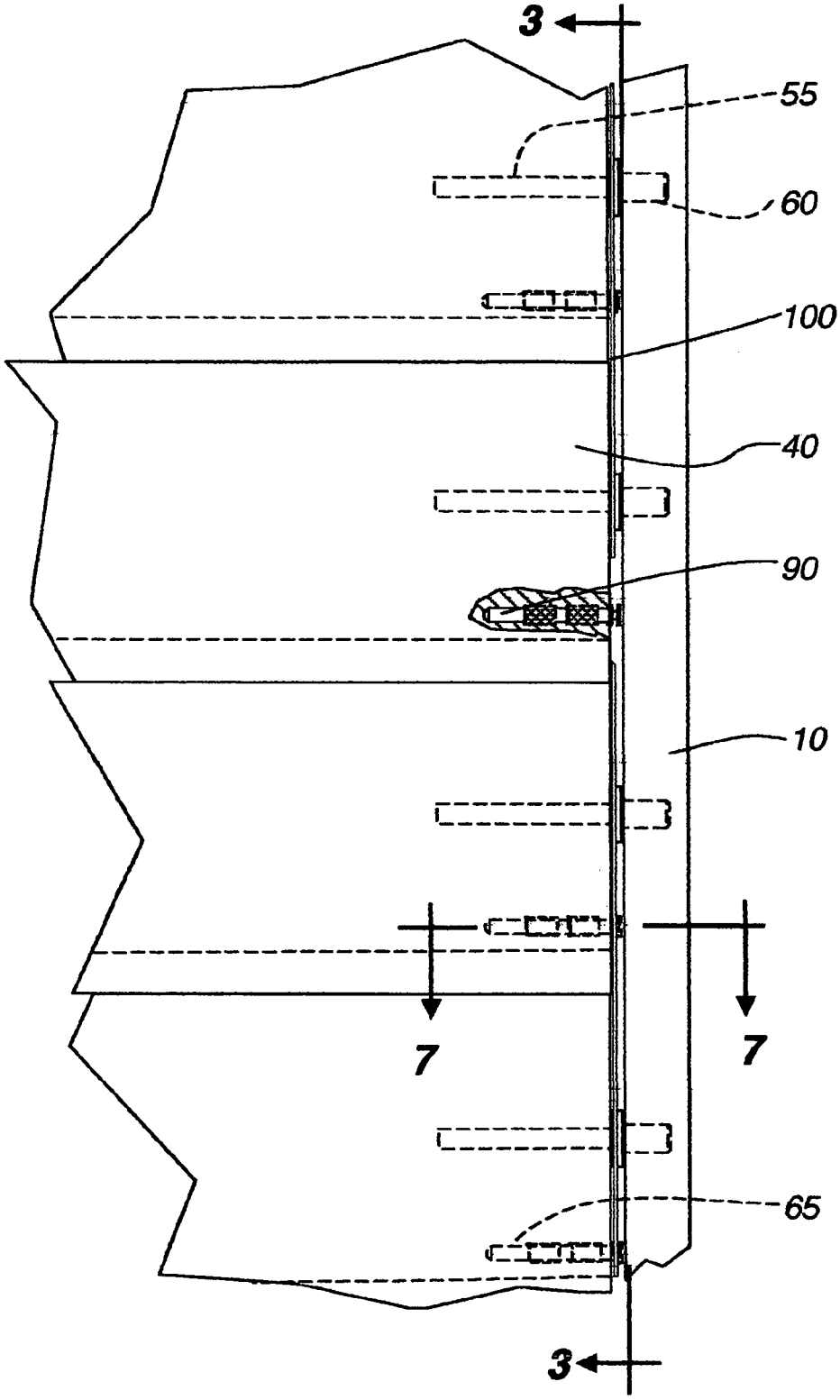
FIG. 2 is a fragmentary front elevation of the louvers in the shutter of FIG. 1 and their respective pivot points and fastener locations.
Figure 3:
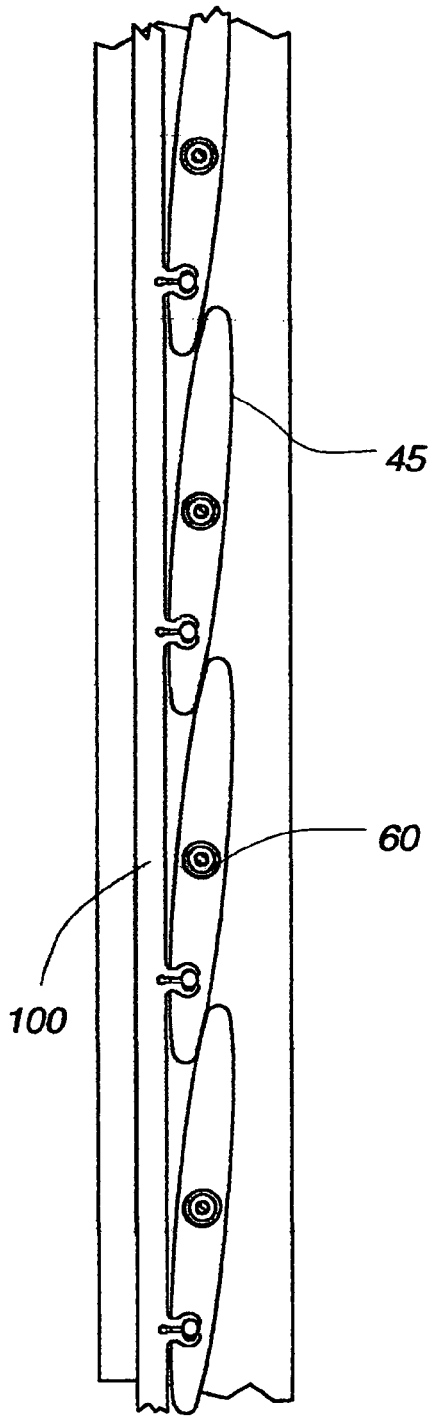
FIG. 3 is a section taken along line 3-3 of FIG. 2.
Figure 4:
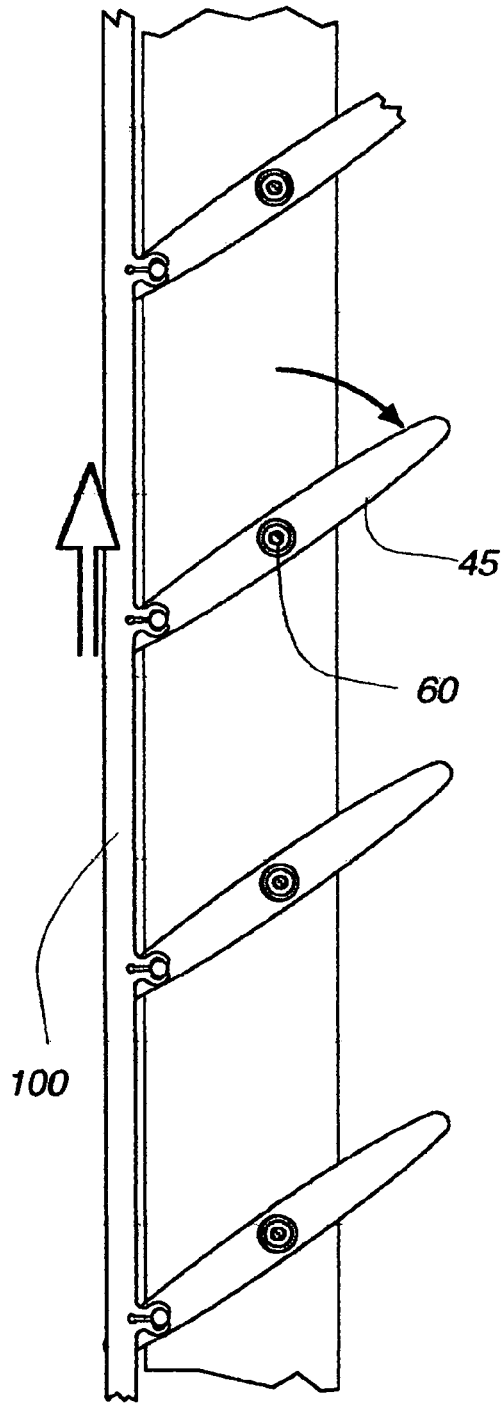
FIG. 4 is a section similar to FIG. 3 showing translation of the louvers by the tilt bar.
Figure 5:
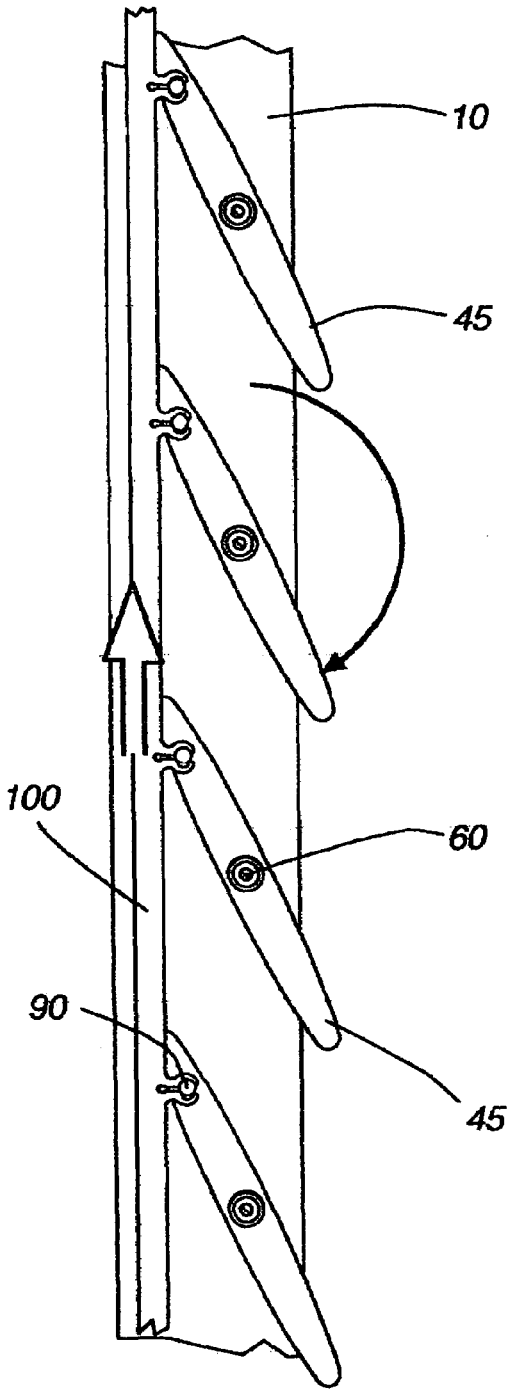
FIG. 5 is a section similar to FIG. 3 showing translation of the louvers by the tilt bar in a different direction.

As shown in FIG. 1, the louvers 40 are pivotally attached to the stile 10 by pivot shafts or louver pins 60 preferably at the transverse center of the longitudinal ends of the louvers so as to enable pivotal rotation about the longitudinal axis of the louver upon movement of the tilt bar 100. Each louver has two longitudinal ends. The length of the louver is variable as is necessary to span the distance between the stiles so that each end 45 of a louver can be pivotally supported by a stile. The ends 45 of the louver are adjacent to the stiles. For purposes of this description and the descriptions of the locations of drillings, hereafter referred to as taps, it will be assumed each end of the louver receives the same taps. Each louver receives a first tap 55 at each end 45 at its center of rotation so as to receive a pivot shaft or louver pin 60. The first tap is preferably transversely centrally located at the ends 45 of the louver to enable the louver to rotate about a longitudinal axis. Next, as seen in FIGS. 2 and 3 a second tap 65 is positioned in the ends 45 at a location proximal to the louver's longitudinal edge. The placement of second tap 65 is located on the ends 45 of a louver to provide a mechanical advantage when pivotal movement of the louver is desired. The second tap 65 at one end of the louver is adapted to receive a tilt pin 90. The attachment of the tilt pin will be discussed below. The second taps are provided in both ends of a louver to provide a choice as to which end will receive the tilt pin therefore determining on which end the tilt bar will be mounted.

Figure 8:
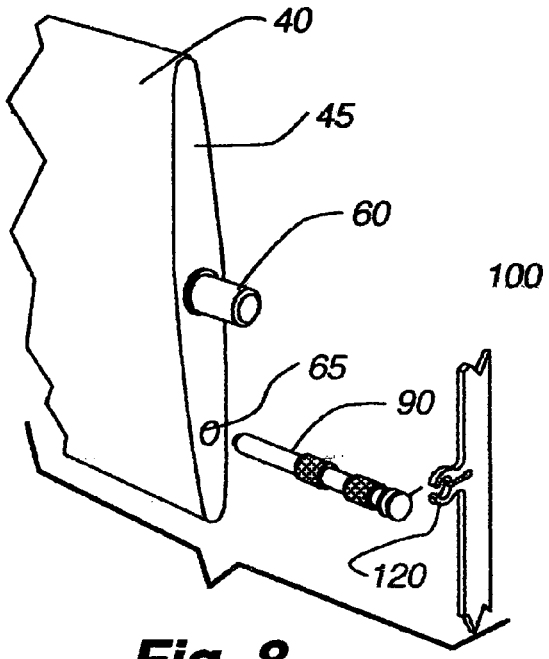
FIG. 8 is an exploded view of the tilt bar, tilt pin and louver.
Figure 9:
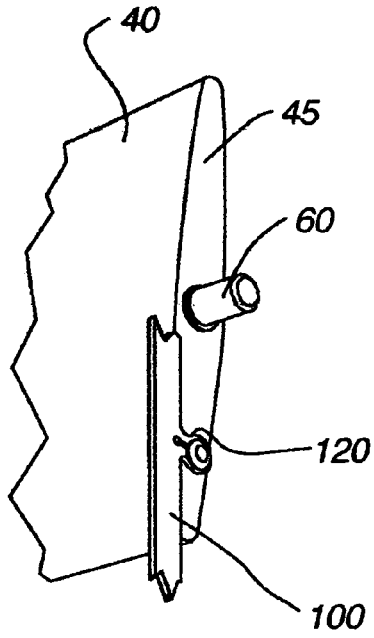
FIG. 9 is a fragmentary isometric of the tilt bar and socket after attachment to the tilt pin.
Figure 11:
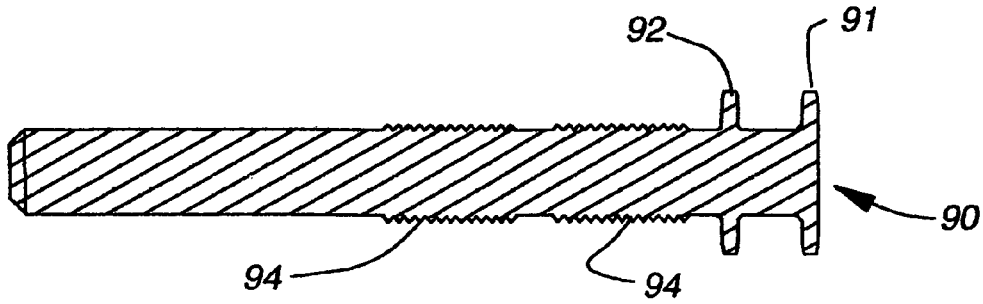
FIG. 11 is a longitudinal section of a tilt pin.

In FIGS. 8 and 9, the tilt bar 100 can be seen to be releasably attached to a tilt pin 90. The means for attachment is a clipping socket 120 formed on the tilt bar 100. The point of attachment for socket 120 to tilt pin 90 is at a neck 93 defined on the tilt pin (FIG. 11). The socket 120 of the tilt bar 100 will be discussed below.

Figure 10:
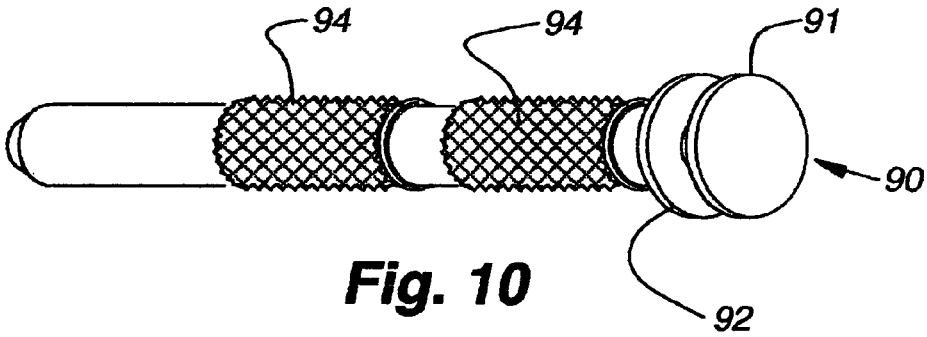
FIG. 10 is an isometric of the tilt pin.

As is shown in FIGS. 10 and 11, the tilt pin 90 is generally cylindrical having a first head 91 and an axially spaced second head 92 at one end. The tilt pin 90 may be constructed from metal, polycarbonate, or other suitable material. A neck 93 is defined in the longitudinal space between the first head 91 and the second head 92. Further, the neck 93 is kept cylindrical so as to provide a bearing surface for a socket 120. As will be appreciated, the second head 92 serves to limit the extent that the tilt pin 90 may be inserted into the second tap 65. Pressing the tilt pin 90 into the second tap 65 may only be up to the second head 92. Thus, as the tilt pin 90 is pressed to the limit of the second head 92, the first head 91 and the second head 92 as well as the neck 93 remain exteriorly of the second tap 40. In this position, the neck 93 is exposed to receive a socket 120 of the tilt bar 100 as will be discussed below.

As can be seen in FIGS. 10, 11, and 11A to the left of the second head 92, are two sets of diamond knurled projection surfaces 94. The knurls 94 are raised above the surface of tilt pin 90, for example 0.095 inches. Thus, as was discussed above, pressing a tilt pin 90 into the second tap 65 to the extent of second head 92 enables the knurls to frictionally engage the inner wall of the second tap 65. The frictional engagement of the knurls with the inner wall of the second tap 65 prevents the tilt pin from easily working free in the second tap upon repeated use of the tilt bar 100.

Figure 7:
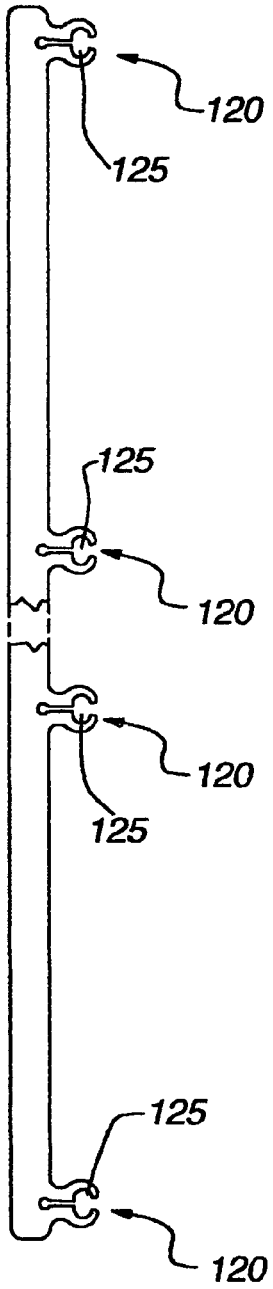
FIG. 7 is a side elevation of the tilt bar.
Figure 7A:
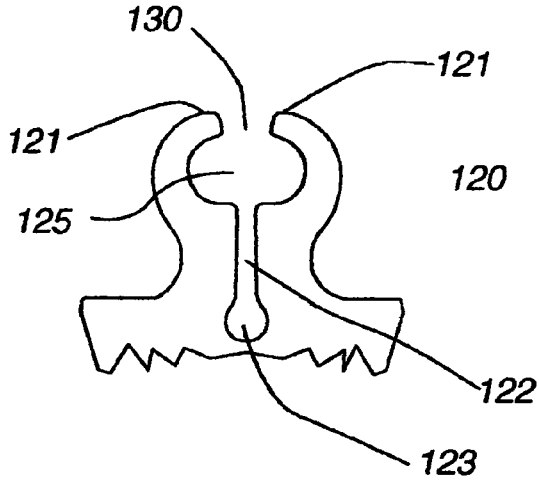
FIG. 7A is an enlarged fragmentary section showing a socket portion of the tilt bar.
Figure 7D:
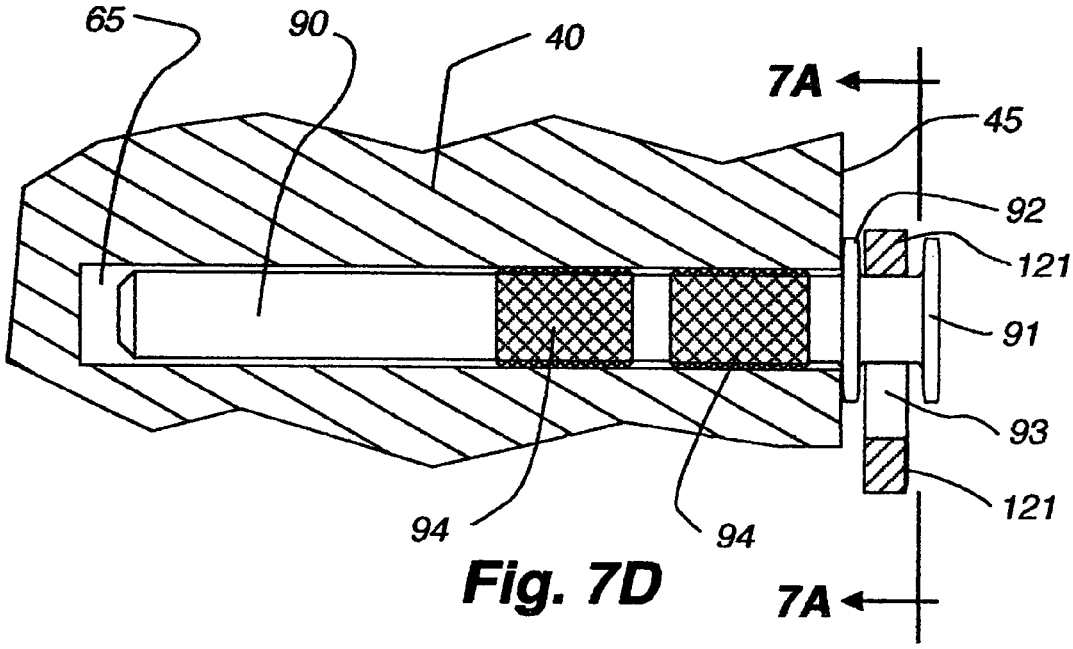
FIG. 7D is a section through a louver with a tilt pin therein.
Figure 12:
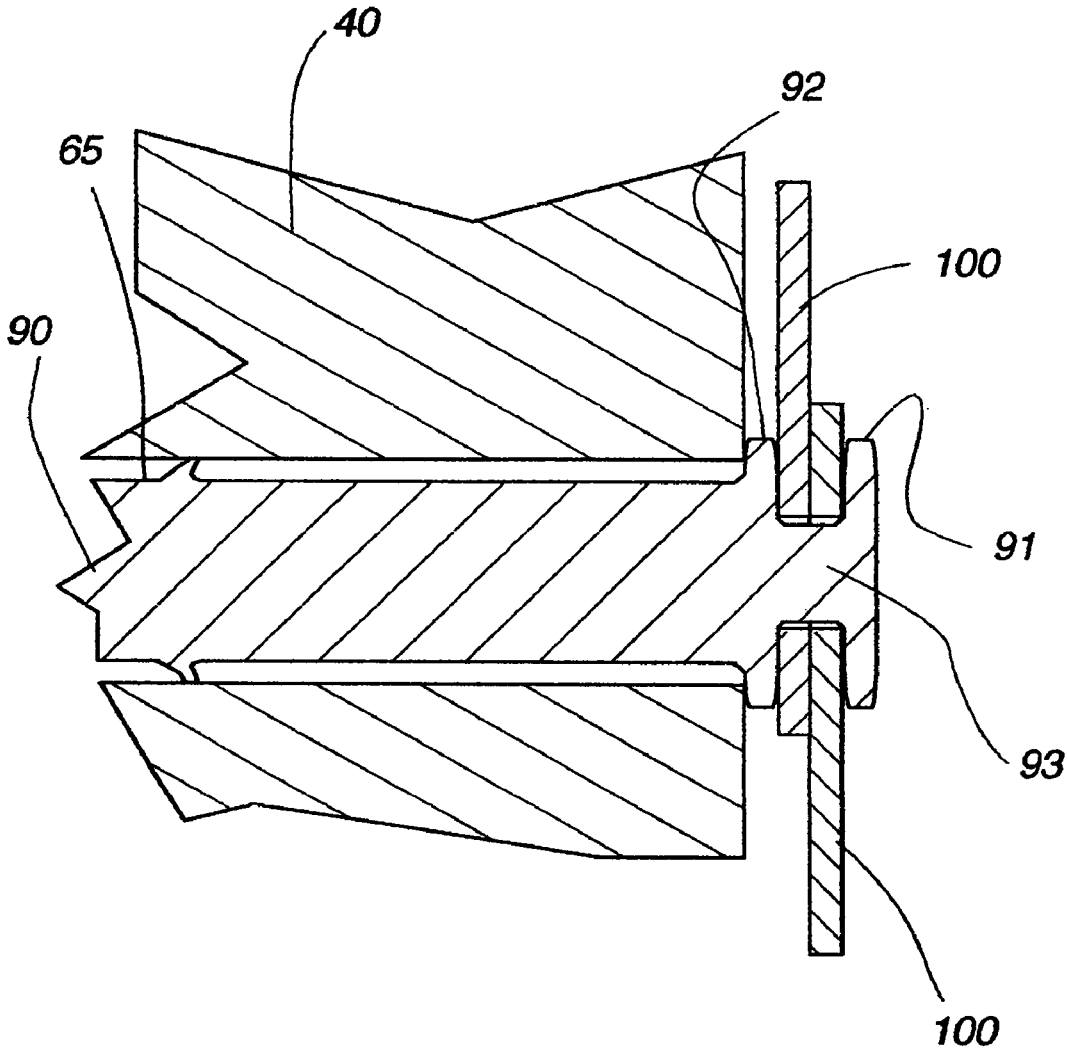
FIG. 12 is a fragmentary section showing two tilt bars connected to a tilt pin in a louver.

The tilt bar 100 is best shown in FIGS. 7 and 7A and may be constructed of metal, polycarbonate, or any other suitable material. In a preferred embodiment, spring tempered steel was used to create resiliency of arms 121 formed on the bar as will be discussed below. The tilt bar is a longitudinal strip or flat bar having a thickness substantially the same as the distance between first head 91 and second head 92, i.e. the width of the neck 93. As seen in FIG. 12, the width of the bar 100 can be made thinner or the width of the neck wider in the event two opposed ends of a pair of tilt bars are connected at one neck. Returning to FIG. 7, the tilt bar 100 includes a plurality of longitudinally spaced sockets 120 extending perpendicularly from the length of the bar in equally spaced increments off one side.

The spacing of the sockets is dependent upon the spacing of the louvers. The sockets 120 are C-shaped in cross-section having at least two of the resilient arms 121. Between the arms 121 an oval opening 125 is defined. As seen in FIGS. 3-6, the tilt bar must be closely adjacent to the louvers as the tilt bar is translated in an up or down movement to fully open and close the louvers. Upon fully closing the louvers as seen in FIG. 3, the tilt bar remains at some minimal distance from the louvers. Thus, the distance of projection of the sockets away from the tilt bar is one of a relationship of the distance necessary for the tilt bar to close the louvers yet not interfere with the louvers.

Figure 7B:
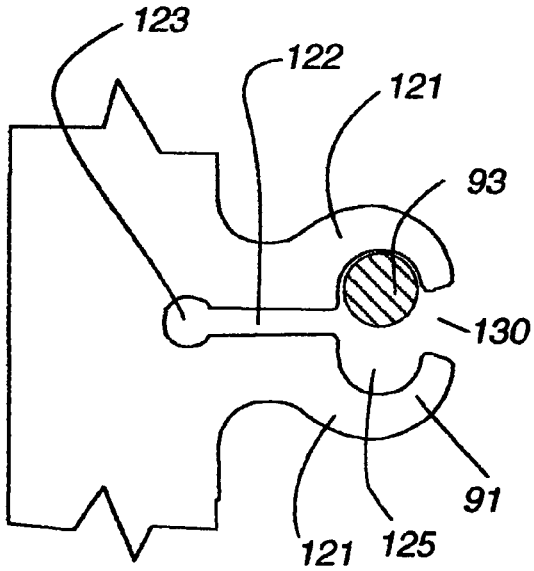
FIG. 7B is a front view of a socket in the tilt bar with a tilt pin therein.

As seen in FIG. 7B, the arms 121 extend arcuately partly around the oval opening 125 but do not connect so as to form entry opening 130 at their distal ends. At their distal ends, the distance between each arm 121 is slightly less than the diameter of the neck 93. As will be appreciated, upon clipping the socket to the neck 93, the arms are adapted to expand from their static position to allow the oval opening 125 to accept the diameter of the neck 93 via entry opening 130. However, once inside the oval opening 125, the neck 93 is captured within the oval opening. The capture of the neck 93 is facilitated by the smaller entry opening between the arms 121 and the resiliency of the arms to return to their static position. Resiliency of the arms is due to the spring steel or other material from which the tilt bar is made and the cooperation with a channel 122 and an opening 123 to be discussed below. As will be appreciated, the resiliency of the arms is necessary to expand so as to accept neck 93 and then return to their static or neutral position so as to retain neck 93 within oval opening 125. Moreover, the resiliency of the arms enables the socket to be removed or be re-captured if that is desired. Thus, the tilt bar may be considered to be removably or releasably attached to the tilt pins.

Referring to FIGS. 7A and 7B, it can be seen that the oval opening 125 allows the neck 93 some amount of movement once captured. While every attempt to maintain proper positioning of the first and second taps is necessary, some errors in the locations of the taps will occur. These errors become a concern when multiplied by the number of taps, especially in a larger shutter having a larger number of louvers. Thus, the allowance of a minimal amount of movement of the neck within the socket reduces binding that may in part be attributable to these miss-measurements as between the plurality of first taps and second taps. Therefore, due to the fixed spacing of the sockets along the length of the tilt bar, the opening 125 is preferably oval in shape. This enables a neck 93 to have a range of movement or "float" within its associated socket. Thus, a smoother movement is provided along the tilt bar provided by the shape of the oval opening 125. This further reduces binding of the tilt bar when the tilt bar is translated.

Figure 7C:
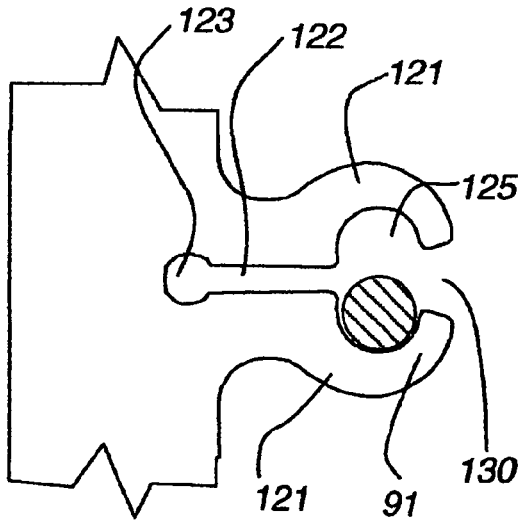
FIG. 7C is a front view similar to FIG. 7B with the tilt pin in a different location.

As shown in FIGS. 7B and 7C, opposite to entry opening 130 is the channel 122 having the expansion opening 123. As was described above, the resilient arms 121 expand to allow entry of a neck 93 into the oval opening 125 and then retract to the spacing defined at the entry opening 130. The channel 122 and the opening 123 cooperate to act as a cantilevered beam to enable the resilient arms 121 to expand upon engagement with the neck 93. Once the neck 93 is positioned within the oval opening 125, the arms return to their pre-determined separation.

In practice, the louvers 40 are tapped at their ends 45 so as to have the aforenoted first and second taps. A pivot shaft or dowel (not shown) is pressed into the first tap 55. A tilt pin 90 is pressed into the second tap 65 at one end of the louvers up to the extent of the second head 92 leaving the first head 91, the second head 92, and the neck 93 projecting outwardly away from the associated end of the louvers. The louvers are inserted into the stiles and the head and bottom bars are attached to the stiles. The tilt bar 100 with its sockets 120 are clipped to the necks of the exposed tilt pins. After attachment of the tilt bar 100, the louvers may be pivoted about the pivots by translation of the tilt bar in an up or down movement.

Figure 15:
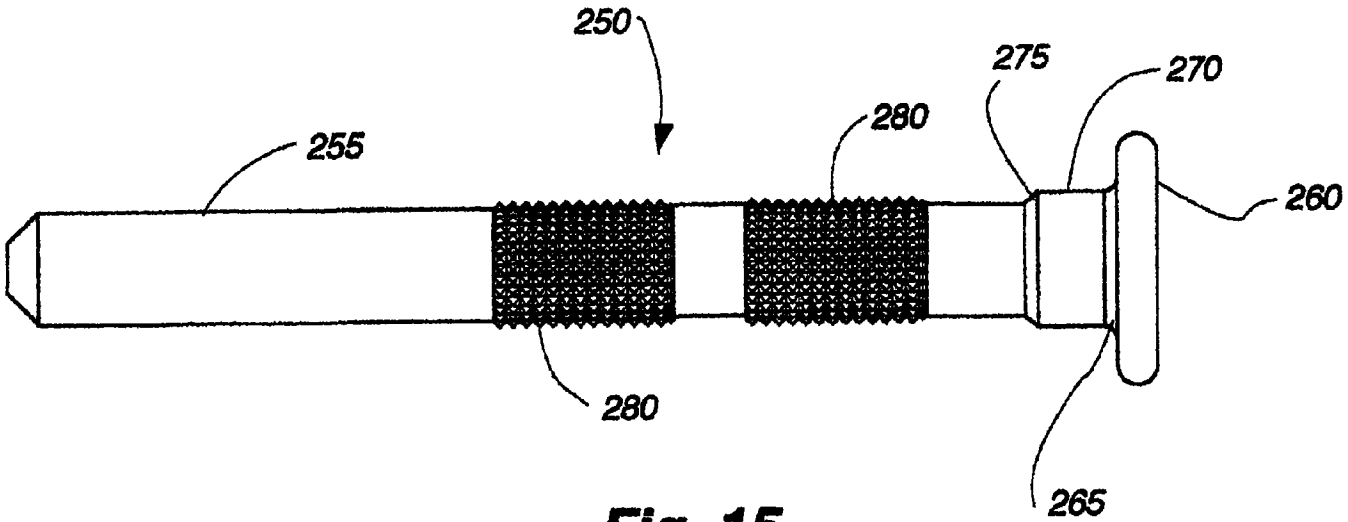
FIG. 15 is a side view of an alternative embodiment of the tilt pin.
Figure 16:
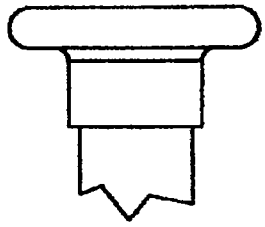
FIG. 16 is a fragmentary side elevation of the head of the pin of FIG. 15.

Another embodiment of a tilt pin can be seen in FIG. 15. In this embodiment, the tilt pin 250 is generally cylindrical in shape having a main body 255. The body of the pin may have a diameter, for example, of 0.850 inches. A head 260 is formed at one end thereof as seen in FIG. 15. The tilt pin 250 may be constructed from metal, polycarbonate, or any other suitable material. Adjacent to the head (to the left of the head as viewed in FIG. 15) is a curved or arcuate portion 265 having a width, for example, of 0.010 inches between the head and a cylindrical bearing surface 270. The purpose of this curved portion will be explained below. The bearing surface 270 is slightly greater in diameter than the main body of the pin having a diameter, for example, of 0.100 inches. It will be appreciated the bearing surface 270 is cylindrical so as to provide a suitable surface for receiving a socket 220 as will be more fully explained below. Adjacent to the bearing surface 270, is an angular or beveled portion 275. This embodiment shows that the angular portion 275 tapers at a 45° angle, for example, in relationship to the bearing surface 270. In another embodiment shown in FIG. 16, the angular portion is shown as ninety degrees. The angle provides a transition from the bearing surface 270 to the main body 255 of the pin. In either event, the angular portion 275 functions as a stop to prevent the pin 250 from being over-inserted into the second tap 65. Moreover, pressing the tilt pin 250 into the second tap 65 may only be up to the angular portion 275 due to its greater diameter than that of the diameter of the second tap 65. Thus, as the tilt pin 250 is pressed to the limit of the angular portion 275, bearing surface 270, curved portion 265 and head 260, remain exteriorly of the opening of the second tap at the end of a louver 40.

The tilt pin 250 can be seen in FIG. 15 having a plurality of diamond knurls 280. The knurls 280, for example, project 0.010 inches above the main body 255. As the pin 250 is inserted into the second tap 65, the knurls 280 frictionally engage the inner wall of the second tap 65 due to their projection outwardly from the main body 255. The frictional engagement of the knurls with the inner wall of the second tap 65 serves to prevent the tilt pin from working free from the second tap upon repeated use of the tilt bar 200.

Figure 13:
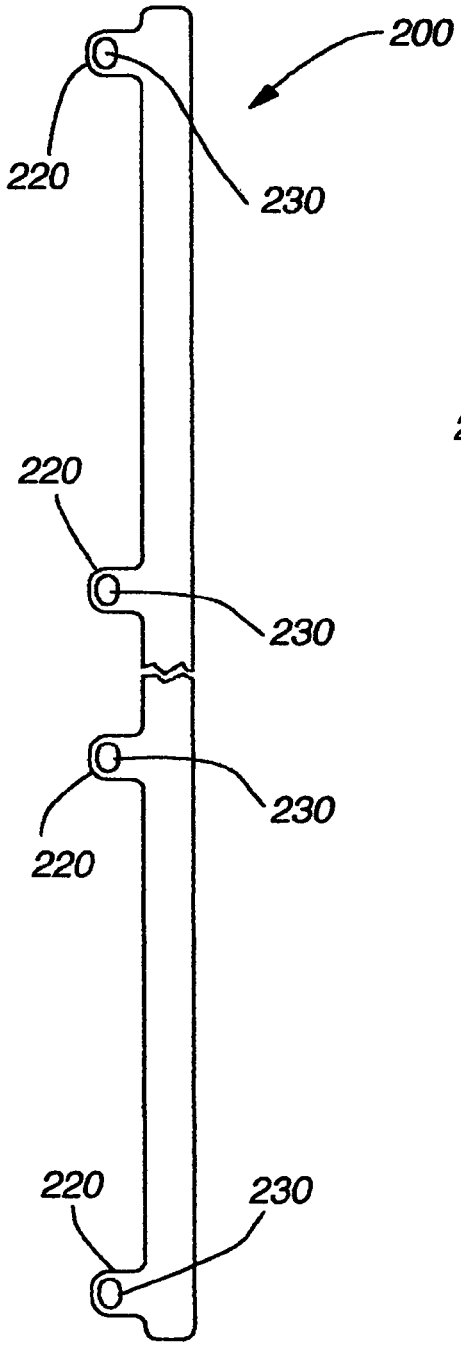
FIG. 13 is a front elevation of an alternative embodiment of tilt bar.
Figure 14:
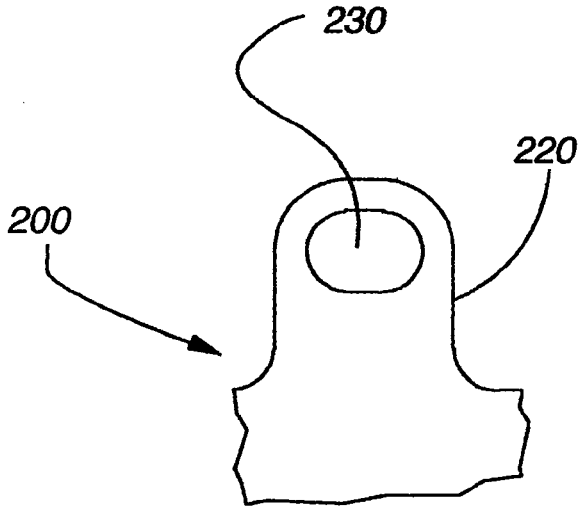
FIG. 14 is an enlarged fragmentary front elevation of a closed socket used in the tilt bar of FIG. 13.

The tilt bar 200, as seen in FIGS. 13 and 14, may be constructed of metal, polycarbonate, or any other suitable material. The thickness of the tilt bar is slightly less than the width of the bearing surface 270. The tilt bar is generally described as a longitudinal strip or thin bar having thereon equally spaced closed sockets 220. The spacing between the closed sockets is dependent upon the spacing of the louvers. The closed sockets 220 project laterally from a side of the tilt bar so as to enable engagement with the tilt pins 250. The closed sockets have an oval shaped opening 230 therein adapted to accept a tilt pin 250. The smallest dimension of the oval opening is, for example, 0.110 inches. As was discussed above, the diameter of bearing surface 270 is, for example, 0.100 inches in diameter. Thus, the smallest dimension of oval opening 230 closely approximates but is slightly greater than the diameter of bearing surface 270. The close approximation between the two dimensions enables some vertical movement of the tilt bar within the oval-shaped opening.

Moreover, the closeness between the bearing surface and the smallest dimension of the oval opening serves to limit horizontal movement. It will be appreciated that enabling vertical movement allows for a better closure in larger shutter panels.

In use, louvers 40 are tapped at their ends 45 so as to have the first and second taps. A pivot dowel (not shown) is pressed into the first tap 55. The louvers are inserted into aligned holes (not seen) in the stiles and the head and bottom bars are attached to the stiles. Each louver is turned outwardly so as to provide access to the second tap 65. The tilt bar 200 is aligned with the second tap 65 so as to place openings 230 over the second taps 65. The tilt pin 250 is first inserted into an opening 230 and subsequently into an aligned second tap 65. The tilt pin 250 is press fitted into the second tap 65 to the extent of angular portion 275. It will be appreciated the bearing surface 270 fits substantially within the opening 230 so as to act as a bearing surface for the tilt bar.

Figure 17:
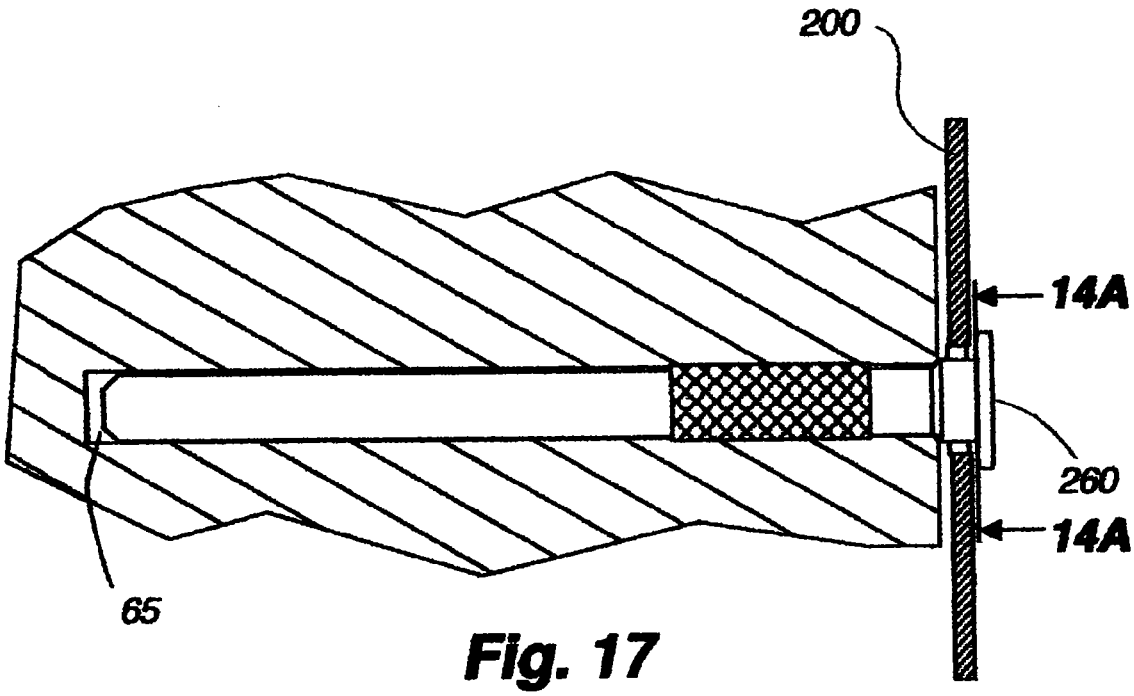
FIG. 17 is a side elevation of a tilt pin similar to that of FIG. 15 connecting a tilt bar to a louver.
Figure 14A:
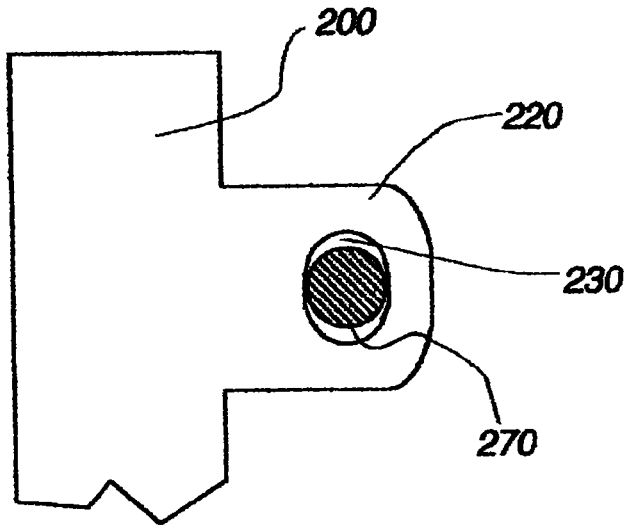
FIG. 14A is a view similar to FIG. 14 with a tilt pin in the closed socket.

As seen in FIG. 17, upon receipt of the tilt pin fully within the second tap 65, the tilt bar 200 is captured adjacent to the end 45 of the louver. In this captured position, the tilt bar 200 is held against the end 45 of the louver. However, it may move toward head 260 to the extent allowed by the curved surface 265. As seen in FIG. 15, the curved surface 265 increases the diameter of bearing surface 270 toward head 260. In this example, the close tolerances between the opening 230 in the tilt bar and the bearing surface 270, permits some movement of the tilt bar toward the head 260 to the extent that the increase in diameter at the curved surface 265 exceeds the dimensions of the opening 230.

Although the present invention has been described with a certain degree of particularity, it is understood that the present disclosure has been made by way of example, and changes in detail or structure may be made without departing from the spirit of the invention as defined in the appended claims.

What is claimed is:

1. A shutter for an architectural opening comprising:

a head bar and a parallel bottom bar, a plurality of stiles perpendicular to and interconnecting said head bar and said bottom bar, and a plurality of elongated louvers mounted for pivotable movement between said stiles, each of said louvers having an axially extending tilt pin of circular cross-section at one end of the louver, and at least one tilt bar, said tilt bar having connectors thereon extending perpendicularly to the axial direction of said louvers for removable attachment to said tilt pins so that translation of said tilt bar moves said louvers between open and closed positions; said connectors being of substantially C-shaped cross section defining resilient arms adapted to spread apart to receive the tilt pins and thereby capture and be releasably attached to the tilt pins, said resilient arms each comprising a continuously curved inner surface extending from a distal end thereof to a medial portion thereof, said curved inner surfaces of each of said connecters facing one another to define an oval opening therebetween continuously slidably retaining a respective one of said tilt pins.

2. The shutter of claim 1 wherein said tilt bar is made of spring steel.

3. The shutter of claim 1 wherein said tilt bar is made of polycarbonate.

4. The shutter of claim 1 wherein said tilt pins have a neck defined by the separation between a first head and a second head.

5. The shutter of claim 1 wherein said tilt pins have a knurled surface for frictionally engaging said louvers.

6. The shutter of claim 1 wherein said tilt pins include bearing surfaces.

* * * * *